US006889757B2

(12) United States Patent
Iwasaki et al.

(10) Patent No.: US 6,889,757 B2
(45) Date of Patent: May 10, 2005

(54) CORE STRUCTURE OF INTEGRAL HEAT-EXCHANGER

(75) Inventors: Mitsuru Iwasaki, Kanagawa (JP); Kazunori Namai, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 09/778,860

(22) Filed: Feb. 8, 2001

(65) Prior Publication Data

US 2001/0035284 A1 Nov. 1, 2001

(30) Foreign Application Priority Data

Feb. 8, 2000 (JP) ..... 2000-030583
Sep. 29, 2000 (JP) ..... 2000-300713

(51) Int. Cl.[7] ..... F28F 13/00
(52) U.S. Cl. ..... 165/135; 165/140
(58) Field of Search ..... 165/140, 135, 165/144

(56) References Cited

U.S. PATENT DOCUMENTS 5,033,540 A * 7/1991 Tategami et al. ..... 165/135
5,076,353 A * 12/1991 Haussmann ..... 165/144
5,329,988 A * 7/1994 Juger ..... 165/152
5,992,514 A 11/1999 Sugimoto et al. ..... 165/135
6,095,239 A * 8/2000 Makino et al. ..... 125/140
6,170,565 B1 * 1/2001 Nishishita ..... 165/135
6,189,603 B1 * 2/2001 Sugimoto et al. ..... 165/135
6,209,628 B1 * 4/2001 Sugimoto et al. ..... 165/135
6,213,196 B1 * 4/2001 Ozaki et al. ..... 165/135
6,354,368 B1 * 3/2002 Nishishita et al. ..... 165/135
6,357,518 B1 * 3/2002 Sugimoto et al. ..... 165/135

FOREIGN PATENT DOCUMENTS

JP 10-231724 9/1998
JP 11-294984 10/1999
JP 2000-220983 8/2000

* cited by examiner

*Primary Examiner*—Ljiljana Ciric
(74) *Attorney, Agent, or Firm*—Foley & Lardner LLP

(57) ABSTRACT

A core structure of an integral heat-exchanger comprises at least two first heat exchanger tubes which extend in parallel with each other; at least two second heat exchanger tubes which extend in parallel with each other, the second heat exchanger tubes juxtaposed with the first heat exchanger tubes; and a corrugated fin including a corrugated first part interposed between the first heat exchanger tubes, a corrugated second part interposed between the second heat exchanger tubes and a flat connection part arranged between the corrugated first and second parts. The corrugated first part of the fin is formed with a plurality of first louvers each extending substantially between the two first heat exchanger tubes. The corrugated second part of the fin is formed with a plurality of second louvers each extending substantially between the two second heat exchanger tubes. The innermost one of the second louvers is positioned away from the innermost end of the corrugated second part of the fin by a given length. The flat connection part is formed with a third louver in the vicinity of the innermost one of the first louvers. The third louver is constructed to obstruct a heat transfer in the fin.

10 Claims, 15 Drawing Sheets

CORE STRUCTURE OF INTEGRAL HEAT-EXCHANGER

BACKGROUND OF THE INVENTION

1. Field of the Invention

The present invention relates to a core structure of an integral heat-exchanger in which corrugate fins of a first heat-exchanger and corrugate fins of a second heat-exchanger are integrally incorporated with one another.

Hitherto, there has been known, as disclosed in Laid-Open Japanese Patent Application No. 10-231724 or 11-294984, such a core structure of an integral heat-exchanger that corrugate fins of a first heat-exchanger and corrugate fins of a second heat-exchanger are integrally incorporated with one another.

In FIG. 18, there is shown a sectional view of a core structure of an integral heat-exchanger disclosed in the Laid-Open Japanese Patent Application 10-231724. It is to be noted that to assemble the heat-exchanger, a plurality of core structures are piled on one another. In each core structure, first heat-exchanger tubes 1 of a first heat-exchanger and second heat-exchanger tubes 2 of a second heat-exchanger are arranged front and back in two rows in an air-stream direction. The first heat-exchanger is a condenser used to cool a refrigerant that flows in a circuit of an automotive air conditioner, and the second heat-exchanger is a radiator used for cooling an engine cooling water. A corrugated fin (wave-like fin) 3 is arranged between the first heat-exchanger tubes 1 and between the second heat-exchanger tubes 2. That is, the corrugated fin 3 includes a front corrugated part (no numeral) disposed between the first heat-exchanger tubes 1 and a rear corrugated part (no numeral) disposed between the second heat-exchanger tubes 2.

The front and rear corrugated parts of the corrugated fin 3 are integrally incorporated with each other through the intermediary of a connection part 3*a*. Louvers 3*b*, 3*c* are formed in the front and rear corrugated parts of the corrugated fin 3, as shown. Cut-out parts 3*d* and louvers 3*e* are formed in the connection part 3*a*.

Since the connection part 3*a* is formed with the cut-out parts 3d and the louvers 3*e* in this core structure, and the heat transfer through the corrugated fins 3 is obstructed by the cut-out parts 3*d* and the louvers 3*e* in the core part of this integral heat-exchanger, it is possible to restrain thermal interference such that heat is transferred, for example, from the higher temperature second heat-exchanger tubes 2 toward the lower temperature first heat-exchanger tubes 1 through the intermediary of the corrugated fins 3.

Referring to FIG. 19, there is shown a core structure of an integral heat-exchanger disclosed in Laid-Open Japanese Patent Application 11-294984. In this core structure, first heat-exchanger tubes 4 of a first heat-exchanger and second heat-exchanger tubes 5 are arranged front and back in two rows in an air stream direction. A corrugated fin (wave-like fin) 6 is arranged between the first heat-exchanger tubes 4 and between the second heat-exchanger tubes 5. That is, the corrugated fin 6 includes a front corrugated part (no numeral) disposed between the first heat-exchanger tubes 4 and a rear corrugated part (no numeral) disposed between the second heat-exchanger tubes 5.

The front and rear corrugated parts of the corrugated fin 6 are integrally incorporated with one another through the intermediary of a connection part 6*a*. Louvers 6*b*, 6*c* are formed in the front and rear corrugated parts of the corrugated fin 6, as shown. Also the connection part 6*a* is formed therein with louvers 6*d*.

In the core structure of this integral heat-exchanger, since the louvers 6*d* are formed in the connection part 6*a*, heat transfer through the corrugated fin 6 is obstructed. Accordingly, it is possible to restrain thermal interference such that heat is transferred, for example, from the higher second temperature heat-exchanger tubes 5 toward the lower temperature first heat-exchanger tubes 4 through the corrugated fins 6.

However, in the core structures of the above-mentioned conventional integral heat-exchangers, due to provision of the cut-out parts 3*d* and louvers 6*d* in the connection parts 3*a*, 6*a*, heat entering into the connection part 3*a*, 6*a* is obstructed. Accordingly, a drawback exists in that heat radiation from the connection part 3*a*, 6*a* cannot be effectively made.

Further if the louvers 3*e*, 6*d* are formed excessively in the connection part 3*a*, 6*a*, the air resistance becomes increased and thus makes the air flow poor, resulting in lowered heat-exchanged performance.

SUMMARY OF THE INVENTION

It is therefore an object of the present invention to provide a core structure of an integral heat-exchanger which is free the above-mentioned drawbacks It is an object of the present invention is to provide a core structure of an integral heat-exchanger, which suppresses or at least minimizes thermal interference between the first heat-exchanger tubes and the second heat-exchanger tubes, and enhances the heat-radiating performance of the second heat-exchanger in the connection part.

According to a first aspect of the present invention, there is provided a core structure of an integral heat-exchanger, which comprises at least two first heat exchanger tubes which extend in parallel with each other; at least two second heat exchanger tubes which extend in parallel with each other, the two second heat exchanger tubes being juxtaposed with the two first heat exchanger tubes; and a corrugated fin including a corrugated first part interposed between the first heat exchanger tubes, a corrugated second part interposed between the second heat exchanger tubes and a flat connection part arranged between the corrugated first and second parts, the corrugated first part of the fin being formed with a plurality of first louvers each extending substantially between the two first heat exchanger tubes; the corrugated second part of the fin being formed with a plurality of second louvers each extending substantially between the two second heat exchanger tubes, the innermost one of the second louvers being positioned away from the innermost end of the corrugated second part of the fin by a given length; and the flat connection part being formed with a third louver in the vicinity of the innermost one of said first louvers, the third louver being constructed to obstruct a heat transfer in the fin.

According to a second aspect of the present invention, there is provided a core structure of an integral heat-exchanger, which comprises at least two first heat exchanger tubes which extend in parallel with each other; at least two second heat exchanger tubes which extend in parallel with each other, the second heat exchanger tubes being juxtaposed with the first heat exchanger tubes; and a corrugated fin including a corrugated first part interposed between the first heat exchanger tubes, a corrugated second part interposed between the second heat exchanger tubes and a flat connection part arranged between the corrugated first and second parts, the corrugated first part of the fin being formed with a plurality of first louvers each extending substantially between the two first heat exchanger tubes; the corrugated second part of the fin being formed with a plurality of second louvers each extending substantially between the two second heat exchanger tubes; and the flat connection part being formed with a plurality of heat radiation portions, each radiation portion being constructed not to largely deteriorate the heat transfer in the fin.

BRIEF DESCRIPTION OF THE DRAWINGS

Other objects and advantages of the present invention will become apparent from the following description when taken in conjunction with the accompanying drawings, in which.

DETAILED DESCRIPTION OF THE EMBODIMENTS

Figure 1:
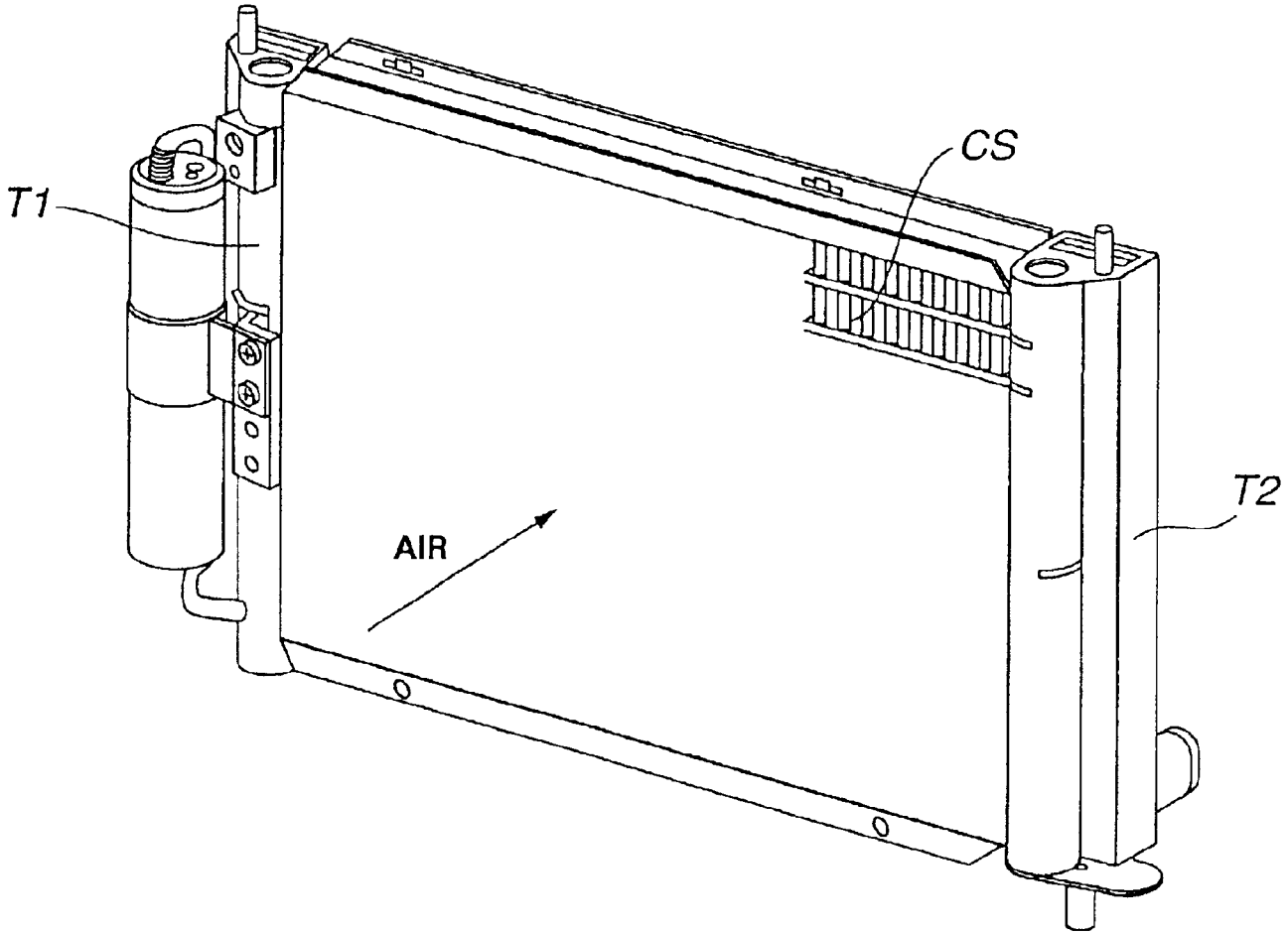
FIG. 1 is a perspective view of an integral heat-exchanger having a core structure according to the present invention.

In the following, detailed explanation of the present invention will be made with reference to the accompanying drawings. Throughout the specification, substantially same parts and portions are denoted by the same reference numerals.

FIG. 1 shows an integral heat-exchanger having a core structure according to the present invention. The integral heat-exchanger generally comprises first and second twin tank portions T1 and T2. Each tank portion T1 or T2 is divided into front and rear tanks. Between the first and second twin tank portions T1 and T2, there extend a plurality of core structures CS which are piled on one another. As will become apparent as the description proceeds, the core structures CS include a front part that is incorporated with the front tanks of the tank portions T1 and T2 to constitute a condenser and a rear part that is incorporated with the rear tanks of the tank portions T1 and T2 to constitute a radiator.

In the following, various embodiments of the present invention will be described with reference to FIGS. 2 to 17. In these drawings except FIG. 3, all of the core structures of these embodiments are arranged to permit air to flow from the left side toward the right side.

Figure 2:
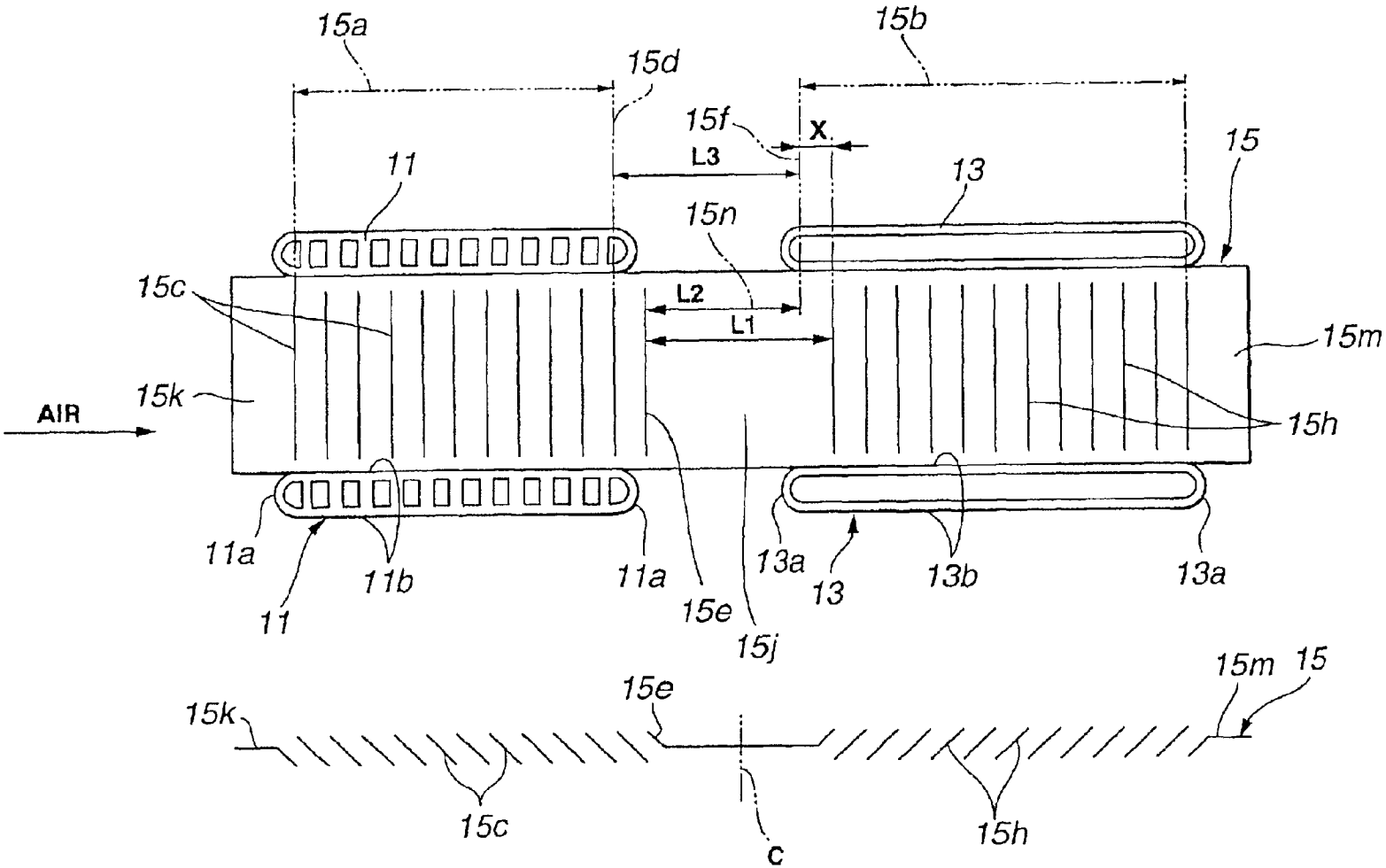
FIG. 2 is a sectional view of a part of core structure of an integral heat-exchanger, which is a first embodiment of the present invention.

FIG. 2 shows a first embodiment of a core structure of an integral heat-exchanger according to the present invention.

In the core structure of this integral heat-exchanger, a corrugated fin 15 of aluminum is arranged between first heat-exchanger tubes 11 of a first heat-exchanger and between second heat-exchanger tubes 13 of a second heat-exchanger. The first heat-exchanger may be a condenser used to cool a refrigerant that flows in a circuit of an automotive air conditioner, and the second heat-exchanger may be a radiator used for cooling an engine cooling water. The corrugated fin 15 includes a front corrugated part (no numeral) disposed between the first heat-exchanger tubes 11 through welded portions and a rear corrugated part (no numeral) disposed between the second heat-exchanger tubes 13 through welded portions. It is to be noted that to assemble the integral heat-exchanger, a plurality of core structures are piled on one another. It is further to be noted that upon assembly on a motor vehicle, the first heat-exchanger is arranged on the upstream side while the second heat-exchanger is arranged on the downstream side, with respect to the flow of air.

The first heat-exchanger tubes 11 and the second heat-exchanger tubes 13 are formed of flattened tubes made of aluminum plate or the like. Each tube 11 or 13 is formed with rounded front and rear ends 11*a*, 13*a*, as shown. The thickness of each tube 11 or 13 is about 1.7 mm, and each tube 11 or 13 is formed at lower and upper surfaces thereof with flat joint portions 11*b*, 13*b*. Each of these flat joint portions 11*b*, 13*b* is connected to crest portions of the corresponding corrugated fin 15 by brazing. That is, the lower surface of each tube 11 or 13 is brazed to upper crest portions of a fin 15 that is positioned below the tube 11 or 13, and the upper surface of each tube 11 or 13 is brazed to lower crest portions of another fin 15 that is positioned above the tube 11 or 13.

In this first embodiment, the corrugated fin 15 has a first joint zone 15*a* where the joint portions 11*b* of the first heat-exchanger tubes 11 are located. In this first joint zone 15*a*, a plurality of function enhancing louvers 15*c* are successively formed at a given pitch of, for example, 1 mm. Further, a single heat transfer preventing louver 15*e* is formed at a position inside of the inner end 15*d* of the first joint zone 15*a*, subsequent to the function enhancing louvers 15*c*, at a pitch equal to the pitch of the latter.

The corrugated fin 15 also has a second joint zone 15*b* where the joint portions 13*b* of the second heat-exchanger tubes 13 are located. In this second joint zone 15*b*, a plurality of function enhancing louvers 15*h* are successively formed in a portion of the second joint zone 15*b* which does not include a zone that extends by a predetermined distance X from the inner end 15*f* of the second joint zone 15*b*.

It is noted that the predetermined distance X is greater than the pitch of the louvers, but preferably less than 2 mm, that is, it is desirably set to 1 mm although it is dependent upon the length L2 of the flat heat transfer part which will be explained later.

A smooth flat connection part 15*j* is provided which is free from louvers, cutout parts and the like, in the corrugated fin 15 between the heat transfer preventing louver 15*e* and the function enhancing louvers 15*h* in the second joint zone 15*b*. It is noted that the flat connection part 15*j* includes a part which serves as a single louver. The length L2 of a flat heat transfer part 15*n* which continuously extends from the second joint zone 15*b* up to the heat transfer preventing louver 15*e* is less than 12 mm, preferably less than 8 mm.

It is noted that there are formed, in this embodiment, a first flat part 15*k* and a second flat part 15*m* in which no louvers other than the single louver in the inner end part are formed, outside of the first joint zone 15*a* and second joint zone 15*b* of the corrugated fin 15.

As is seen from the lower illustration of FIG. 2, the corrugated fin 15 is formed with louvers 15*c*, 15*e*, 15*h* which are symmetric on opposite sides of the center line C of the corrugated fin 15.

In the core structure of the integral heat-exchanger, the function enhancing louvers 15*h* are successively formed in the second joint zone 15*b*, except the part which extends in the predetermined distance X from the inner end 15*f* of the second joint zone 15*b*. Accordingly, heat from the second heat-exchanger tubes 13 is surely transferred from the zone which extends in the predetermined distance X from the inner end 15*f* of the second joint zone 15*b*, to the flat connection part 15*j*.

Heat led to the flat connection part 15*j* is effectively radiated into the open air passing by the corrugated fin 15, in the flat connection part 15*j*.

Furthermore, since the heat transfer preventing louver 15*e* is formed, subsequent to the function enhancing louvers 15*c*, in the zone inside of the inner end 15*d* of the flat connection part 15*j*, heat is restrained from being transferred from the flat connection part 15*j* toward the first heat-exchanger tubes 11, by means of the heat transfer preventing louver 15*e*. Accordingly, thermal interference between the first heat-exchanger tubes 11 and the second heat-exchanger tubes 13 can be suppressed or at least minimized.

That is, in the core structure of the integral heat-exchanger as mentioned above, since the heat transfer preventing louver 15*e* is formed, subsequent to the function enhancing louvers 15*c*, in the zone inside of the inner end 15*d* of the first joint zone 15*a* while the function enhancing louvers 15*h* are successively formed in the second joint zone 15*b*, except the part extending in the predetermined distance X from the inner end 15*f* of the second joint zone 15*b*, and since the flat connection part 15*j* is formed between the heat transfer preventing louver 15*e* and the function enhancing louvers 15*h* in the second joint zone 15*b*, the heat interference between the first heat-exchanger tubes 11 and the second heat-exchanger tubes 13 can be reduced, and the function of heat radiation of the second heat-exchanger can be enhanced in the flat connection part 15.

Further, in the core structure of the integral heat-exchanger, as mentioned above, since the length L2 of the flat heat transfer part 15*n* is less than 12 mm, and since the predetermined distance X is greater than the pitch of the louvers, the heat radiation can be effectively made in the flat connection part 15*j*.

That is, should the predetermined distance X be less than the pitch of the louvers, heat with which the flat connection part 15*j* can be sufficiently used, could not be transferred. However, should the predetermined distance X exceed 2 mm, the heat-exchanging function of the function enhancing louvers 15*h* would be deteriorated. Thus, it is preferable to set the predetermined distance X to be less than 2 mm.

If the length of the flat heat transfer part 15*n* exceeds 12 mm, substantially no heat transfer is effected in the part beyond 12 mm, that is, it does not contribute to heat radiation.

Thus, it is preferable to set the value of the length L2 of the flat heating transfer part 15*n* at less than 8 mm.

Thus, it is preferably be set to a value less than 8 mm.

Figure 3:
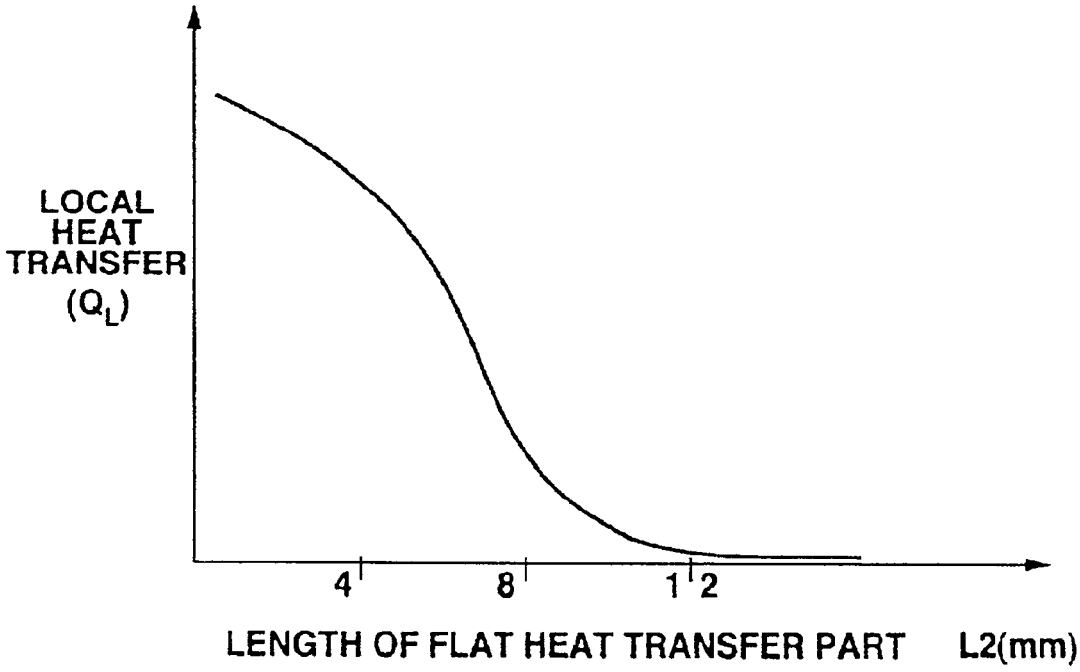
FIG. 3 is a graph showing a relation between the length of a corrugated fin and a local heat transfer.

Referring to FIG. 3, there is shown a graph which shows a relationship between the local heat transfer $Q_L$ of the corrugated fin 15 and the length L2 of the flat heat transfer part 15*n*, which was obtained through simulation analysis on the basis of a basic formula for the function of a heat-exchanger. From this graph, it is found that substantially no heat transfer occurs in a part where the length L2 of the flat heat transfer part exceeds 12 mm.

The above-mentioned basic formula is exhibited by:

$$Q_L = a_L A(T_{fL} - T_{aL}) \quad (1)$$

where $Q_L$ is the local heat transfer, $a_L$ is a local heat transfer coefficient, A is a local heat radiation area, $T_{fL}$ is a fin temperature, and $T_{aL}$ is an air temperature.

In the core structure of the integral heat-exchanger as mentioned above, louvers 15*c*, 15*e*, 15*d* are symmetrically formed on the opposite sides of the center line C of the corrugated fin 15, and accordingly, the corrugated fin 15 can be surely manufactured in a well-balanced manner. Furthermore, a single heat transfer preventing louver 15*e* is formed in the zone inside of the inner end 15*d* of the first joint zone 15*a*, and accordingly, the length L1 of the flat connection part 15*j* can be sufficiently ensured, thereby it is possible to surely carry out heat transfer.

It is noted that although the explanation has been made of such an embodiment that the single heat transfer preventing louver 15*e* is formed in the zone inside of the inner end 15*d* of the first joint zone 15*a*, the present invention should not be limited to this embodiment. That is, a plurality of heat transfer preventing louvers may be provided.

Figure 4:
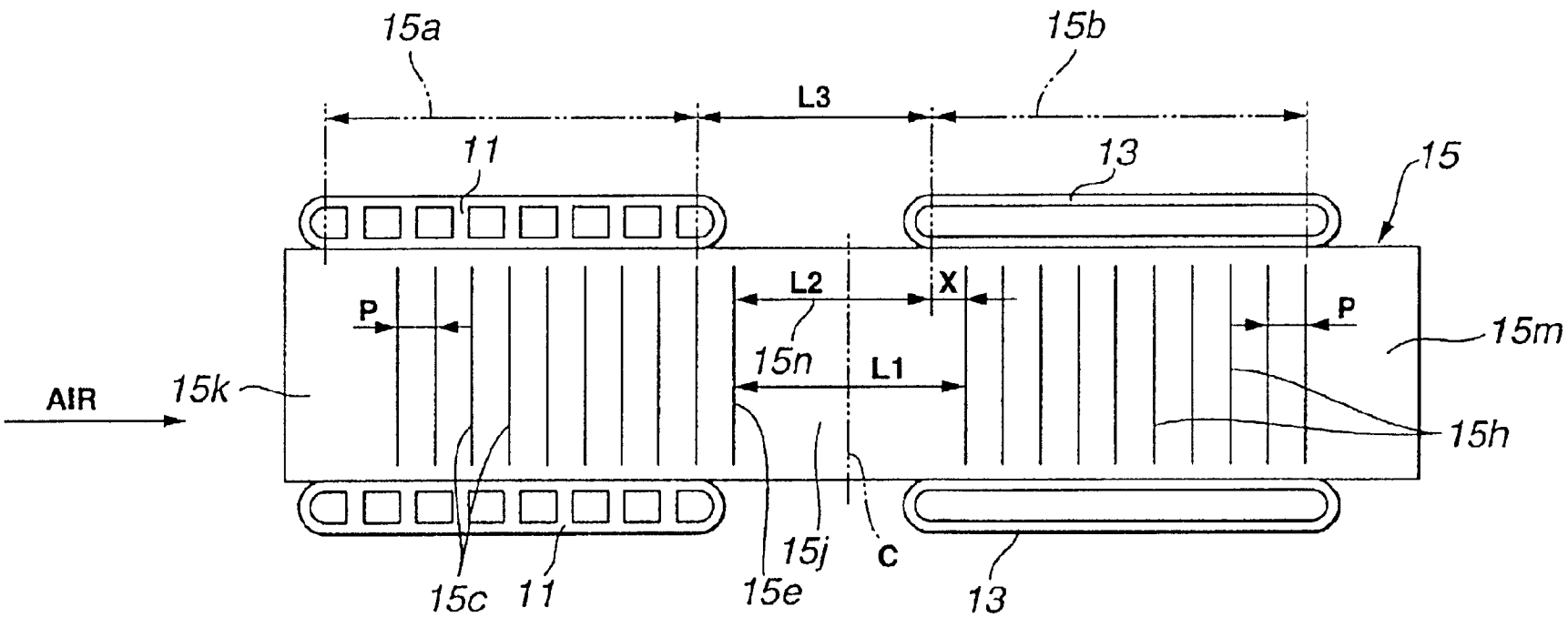
FIG. 4 is a view similar to FIG. 2, but showing a second embodiment of the present invention.
Figure 5:
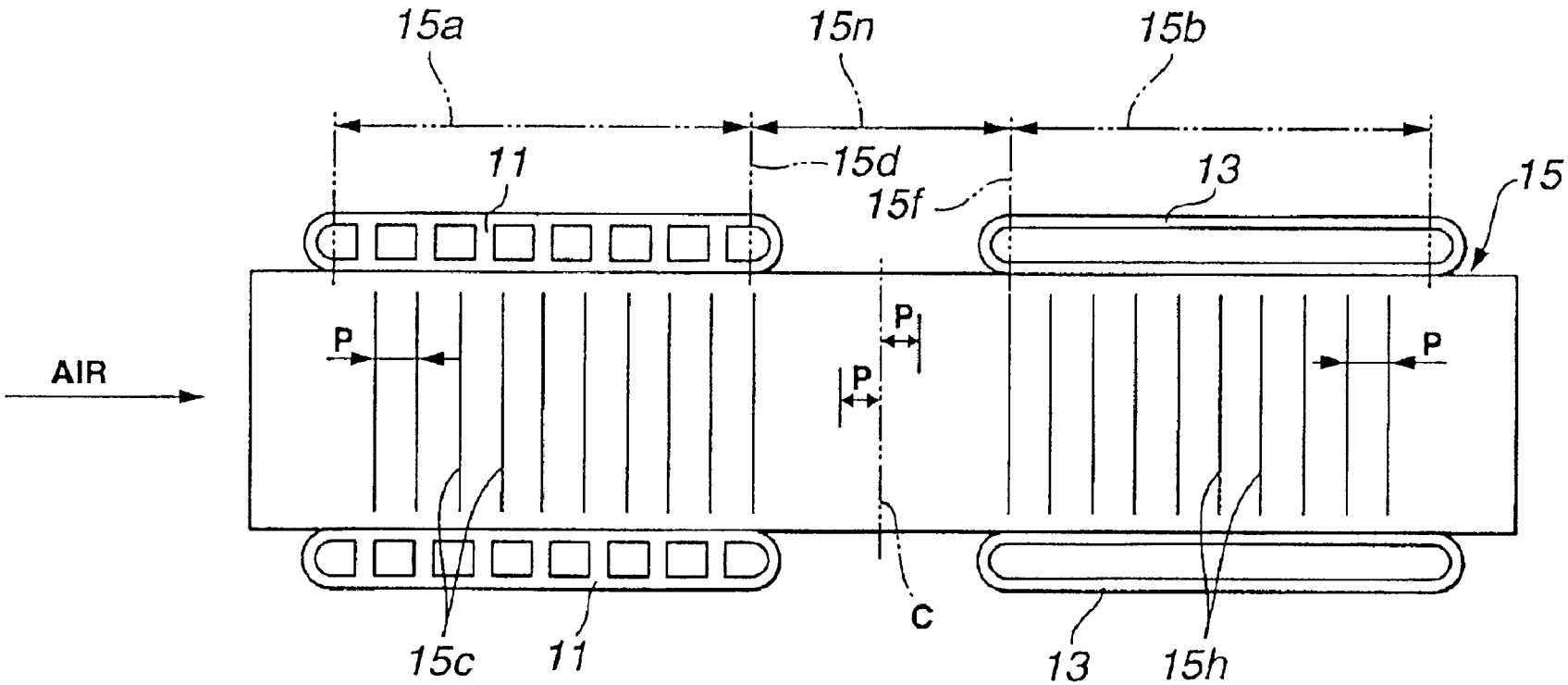
FIG. 5 is a view similar to FIG. 4, but showing a basic arrangement of a core structure.

Referring to FIG. 4, there is shown a second embodiment of the present invention. In this embodiment, the external dimensions of the first heat-exchanger tubes 11 are equal to that of the second heat-exchanger tubes 13, and the length of the first joint zone 15*a* is equal to that of the second joint zone 15*b*. The length L1 of the flat joint part 15*j* is equal to the length L3 between the joint zones. Furthermore, the louvers 15*c*, 15*e*, 15*h* of the corrugated fin 15 in the air flow direction are symmetrically formed on opposite sides of the center line C of the corrugated fin 15. Furthermore, all louvers 15*c*, 15*e*, 15*d* are arranged at a constant pitch P.

In this core structure of this second embodiment, since the length of the flat connection part 15*j* is equal to the length between the joint zones, the heat transfer preventing louver 15*e* and the predetermined distance X can be easily provided by shifting the configuration of the corrugated fin 15 from the basic configuration thereof. That is, in the basic configuration shown in FIG. 5, the center line C of the corrugated fin 15 is located at the center position between the first heat-exchanger tubes 11 and the second heat-exchanger tubes 13, and the function enhancing louvers 15*c*, 15*h* are successively formed in the first joint zone 15*a* and the second joint zone 15*b*. Furthermore, the function enhancing louvers 15*c*, 15*h* are formed at positions which correspond to the inner end 15*d* of the first joint zone 15*a* and the inner end 15*f* of the second joint zone 15*b*. Accordingly, by shifting the center line C of the corrugated fin 15 from this basic configuration by one pitch P toward the second heat-exchanger tubes 13, that is, toward the downstream side with respect to the air flow direction, as shown in FIG. 4, there can be easily obtained such a core structure that the heat transfer preventing louver 15*e* is formed on the fin 15 at the side of the first heat-exchanger tubes 11 while the predetermined distance X is provided on the fin 15 at the side of the second heat-exchanger tubes 13.

Figure 6:
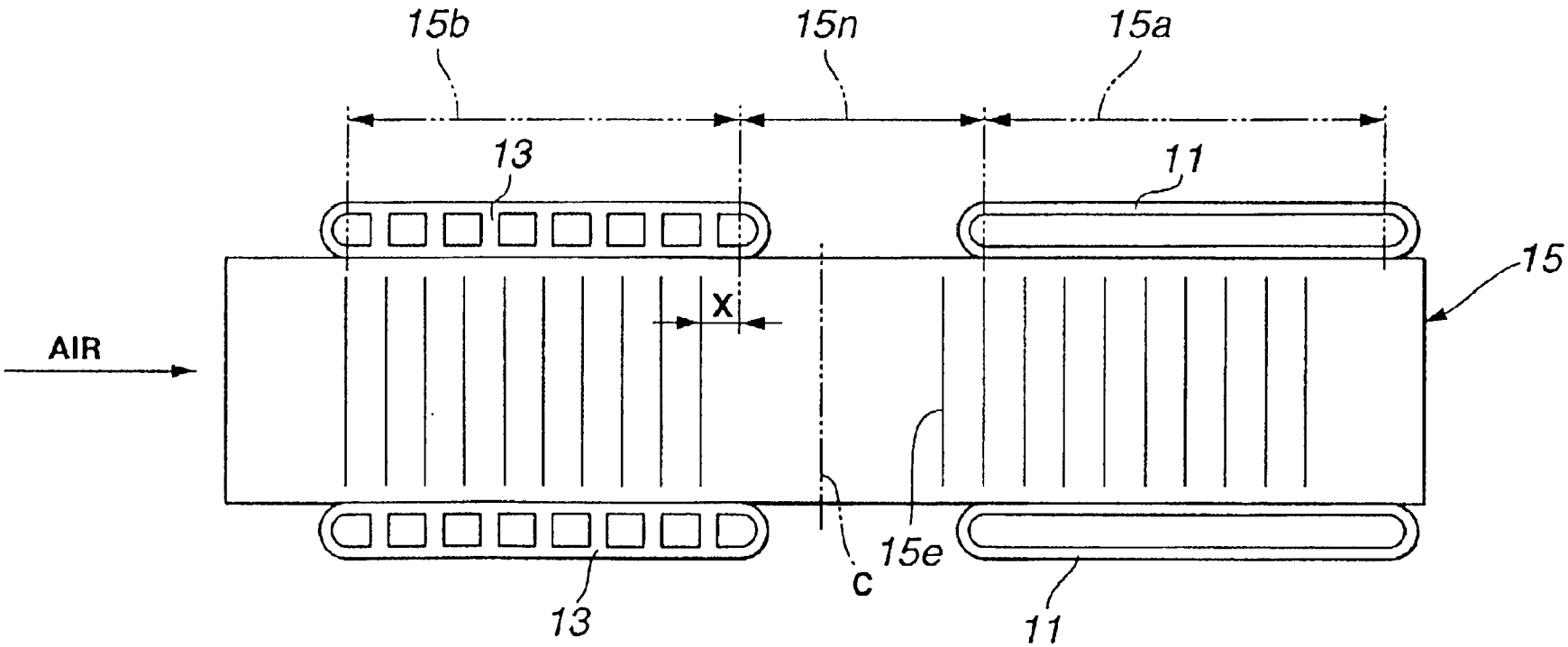
FIG. 6 is a view similar to FIG. 2, but showing a third embodiment of the present invention.

Referring to FIG. 6, there is shown a third embodiment of the present invention. The core structure of this third embodiment is substantially the same as that of the above-mentioned second embodiment of FIG. 4 except the arrangement of the first and second heat-exchanger tubes 11 and 13 with respect to the air flow direction. That is, in the third embodiment, the second heat-exchanger tubes 13 are arranged at an upstream side and the first heat-exchanger tubes 11 are arranged at a downstream side, as shown in FIG. 6. In this arrangement, the heat transfer preventing louver 15*e* is provided in the vicinity of the first heat-exchanger tubes 11 for the radiator. Thus, undesired thermal interference from the higher temperature side, viz., the second heat-exchanger tubes 13 to the lower temperature side, viz., the first heat-exchanger tubes 11 is suppressed. Furthermore, in this third embodiment, the heat radiation effect of the lower temperature side heat exchanger (viz., first heat exchanger or the condenser) can be enhanced.

Figure 7:
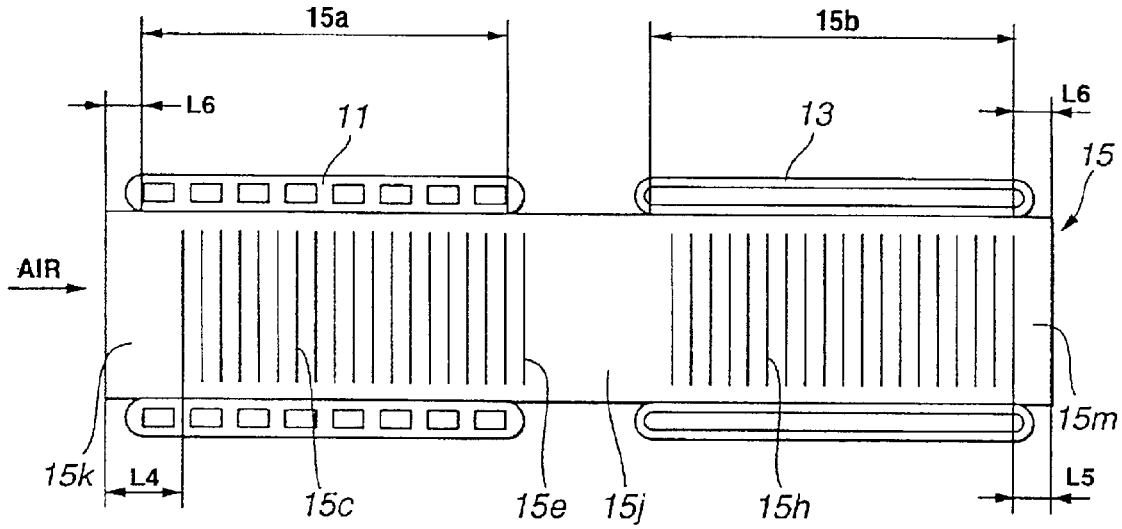
FIG. 7 is a view similar to FIG. 2, but showing a fourth embodiment of the present invention.

Referring to FIG. 7, there is shown a fourth embodiment of the present invention. This embodiment has such a configuration that the length of the first joint zone 15*a* for the first heat-exchanger tubes 11 is equal to that of the second joint zone 15*b* for the second heat-exchanger tubes 13.

The louvers 15*c*, 15*e*, 15*h* of the corrugated fin 15 are symmetrically formed on the opposite sides of the flat connection part 15*j*, and a first flat part 15*k* and a second flat part 15*m* in which no louvers are formed are obtained on both sides of the corrugated fin 15. Furthermore, the first flat part 15*k* and the second flat part 15*m* have different lengths L4, L5, respectively, and the first flat part 15*k* and the second flat part 15*m* are projected from the first joint zone 15*a* and the second joint zone 15*b*, respectively, by an equal length L6. Further, in this fourth embodiment, the first heat transfer preventing louver 15*e* is formed on the fin 15 at the side of the first heat-exchanger tubes 11, and the length L4 of the first flat part 15*k* is longer than the length L5 of the second flat part 15*m*.

In the core structure of this embodiment, since the louvers 15*c*, 15*e*, 15*d* of the corrugated fin 15 are symmetrically formed on the opposite sides of flat connection part 15*j*, deformation of the corrugated fin which is likely to occur during processing of the corrugated fin 15 can be suppressed. Further, since the lengths of the first flat part 15*k* and the second flat part 15*m* are different from each other, and since they are projected from the first joint zone 15*a* and the second joint zone 15*b*, respectively, by an equal length L6, the corrugated fin 15 can be arranged in a well-balanced manner between the first heat-exchanger tubes 11 and the second heat-exchanger tubes 13.

Figure 8:
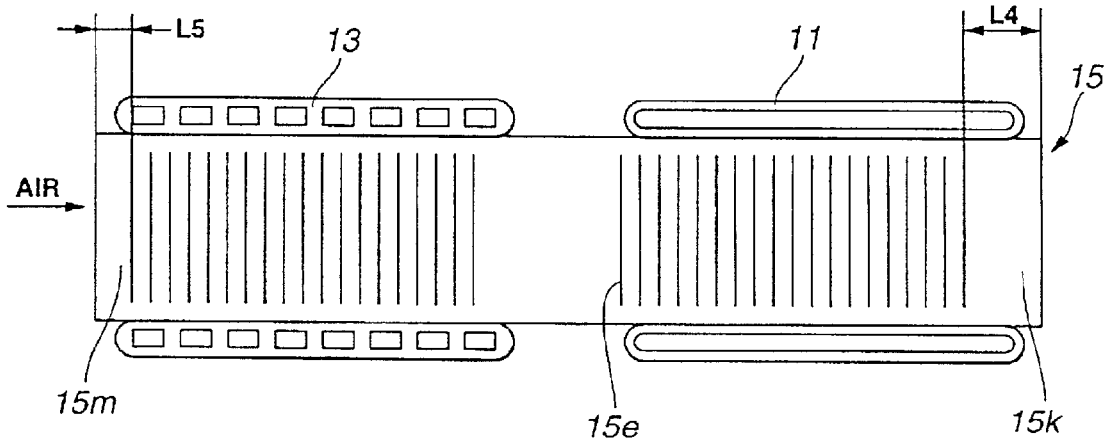
FIG. 8 is a view similar to FIG. 2, but showing a fifth embodiment of the present invention.

Referring to FIG. 8, there is shown a fifth embodiment of the present invention. The core structure of this fifth embodiment is substantially the same as that of the above-mentioned fourth embodiment of FIG. 7 except the arrangement of the first and second heat-exchanger tubes 11 and 13 with respect to the air flow direction. That is, in this fifth embodiment, the second and first heat-exchanger tubes 13 and 11 are arranged at upstream and downstream sides respectively, as shown in FIG. 8.

In this fifth embodiment, advantages substantially equal to those of the above-mentioned fourth embodiment can be obtained.

Figure 9:
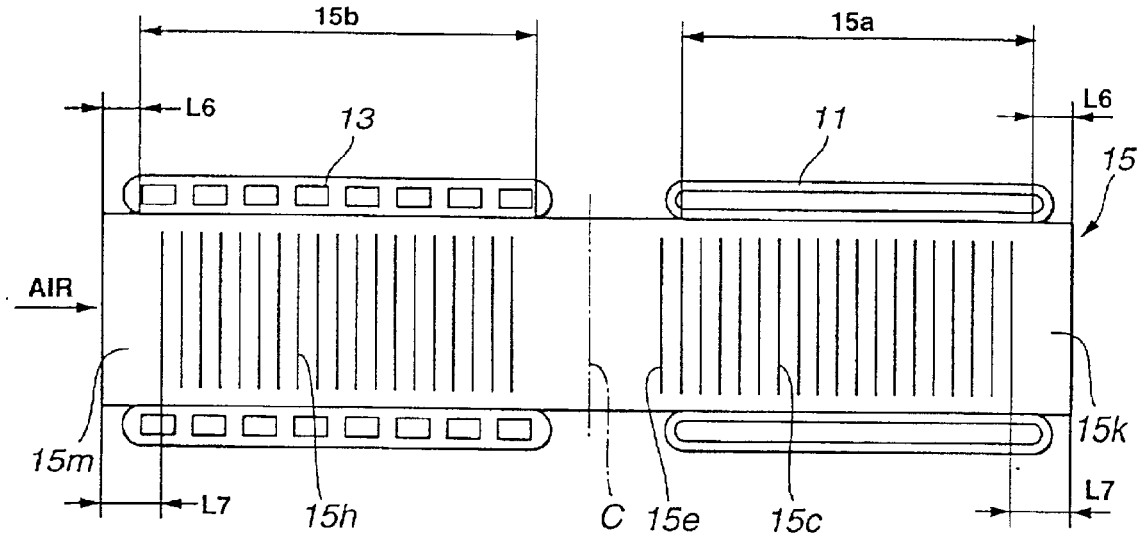
FIG. 9 is a view similar to FIG. 2, but showing a sixth embodiment of the present invention.

Referring to FIG. 9, there is shown a sixth embodiment of the present invention. The core structure of this embodiment is substantially the same as that of the above-mentioned first embodiment of FIG. 2 except the arrangement of the first and second heat-exchanger tubes 11 and 13. As shown, the heat transfer preventing louver 15*e* is formed on the fin 15 at the side of the first heat-exchanger tubes 11.

In the core structure of this fifth embodiment, the louvers 15*c*, 15*d*, 15*h* of the corrugated fin 15 are symmetrically formed on the opposite sides of the center line C of the corrugated fin 15, and accordingly, undesired deformation of the corrugated fin 15, which tends to appear during processing thereof, can be suppressed or at least minimized. Furthermore, since the width of the first heat-exchanger tubes 11 is different from that of the second heat-exchanger tubes 13, and since the first flat part 15*k* and the second flat part 15*m* are projected respectively from the first joint zone 15*a* and the second joint zone 15*b* by an equal length, the corrugated fin 15 can be arranged between the first heat-exchanger tubes 11 and the second heat-exchanger tubes 13 in a well-balanced manner.

Figure 10:
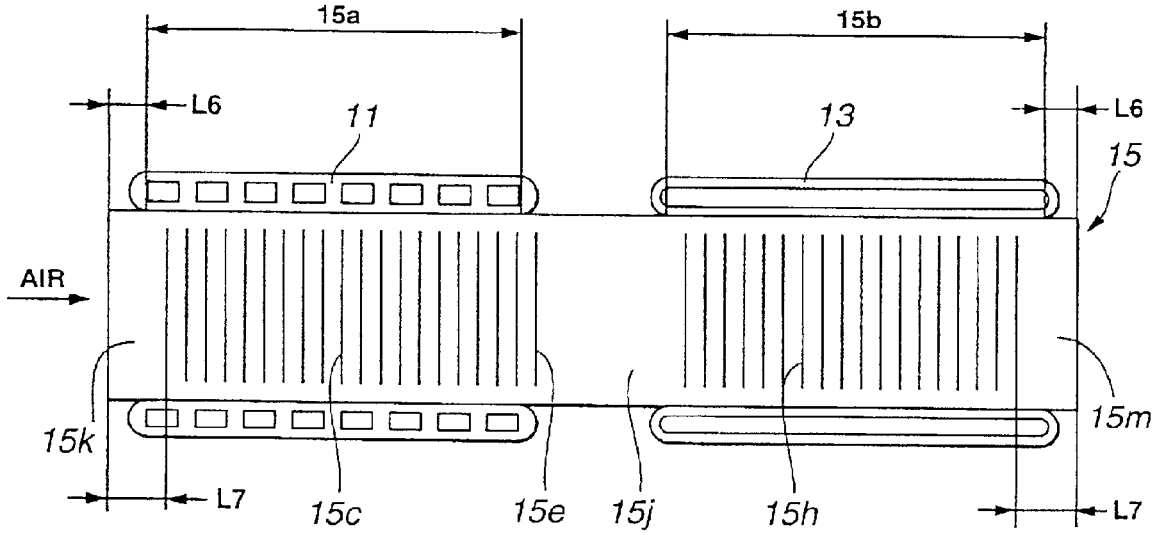
FIG. 10 is a view similar to FIG. 2, but showing a seventh embodiment of the present invention.

Referring to FIG. 10, there is shown a seventh embodiment of the present invention. In this embodiment, the length of the first joint zone 15*a* for the first heat-exchanger tubes 11 is equal to that of the second joint zone 15*b* for the second heat-exchanger tubes 13. The numbers of the louvers 15*c*, 15*e*, 15*h* of the corrugated fin 15 are different from each other on the opposite sides of the flat connection part 15*j*. That is, in this seventh embodiment, the number of the louvers on the fin 15 at the side of the first heat-exchanger tubes 11 is greater than that on the side of the second heat-exchanger tubes 13 by one, and the heat transfer preventing louver 15*e* is formed on the fin 15 at the upstream side with respect to the air flow direction, that is, at the side of the first heat-exchanger tubes 11. Furthermore, the length L7 of the first flat part 15*k* is equal to that of the second flat part 15*m*, and the first flat part 15*k* and the second flat part 15*m* are projected respectively from the first joint zone 15*a* and the second joint zone 15*m* by an equal length L6.

In the core structure in this seventh embodiment, since the numbers of the louvers 15*c*, 15*e*, 15*h* of the corrugated fin 15 in the air flow direction are different from each other on the opposite sides of the flat connection part 15*j*, and since the first flat part 15*k* and the second flat part 15*m* are projected respectively from the first joint zone 15*a* and the second joint zone 15*m* by an equal length, the corrugated fin 15 can be arranged in an well-balanced manner between the first heat-exchanger tubes 11 and the second heat-exchanger tubes 13.

Figure 11:
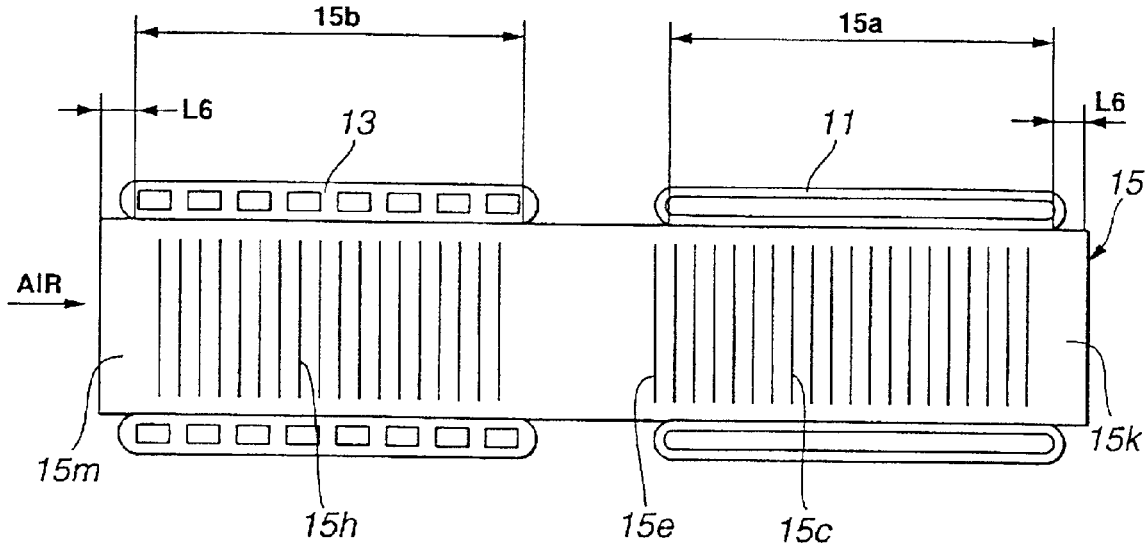
FIG. 11 is a view similar to FIG. 2, but showing an eighth embodiment of the present invention.

Referring to FIG. 11, there is shown an eighth embodiment of the present invention. The core structure of this embodiment is substantially the same as that of the above-mentioned seventh embodiment of FIG. 10 except the arrangement of the first and second heat-exchanger tubes 11 and 13. In this eighth embodiment, the heat transfer preventing louver 15*e* is formed on the fin 15 at the downstream side with respect to the air flow direction, that is, at the side of the first heat-exchanger tubes 11, and first flat part 15*k* and the second flat part 15*m* are projected respectively from the first joint zone 15*a* and the second joint zone 15*b* by an equal length L6.

In this eighth embodiment, substantially same advantages as those of the seventh embodiment can be obtained.

Figure 12:
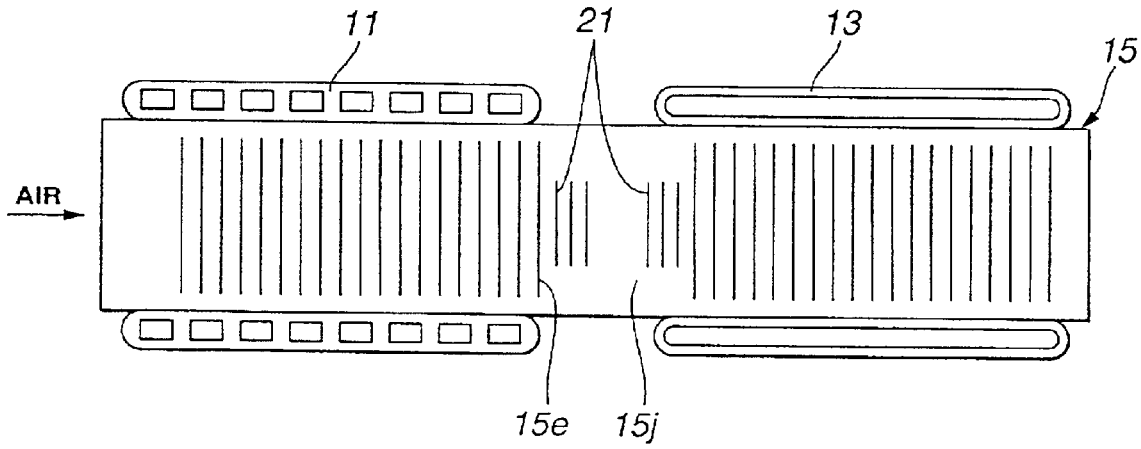
FIG. 12 is a view similar to FIG. 2, but showing a ninth embodiment of the present invention.

Referring to FIG. 12, there is shown a ninth embodiment of the present invention. In this ninth embodiment, the flat connection part 15*j* is formed therewith a plurality of heat radiation parts for radiating heat without greatly hindering heat transfer from the second heat-exchanger tubes 13. In this ninth embodiment, the heat radiation parts are auxiliary heat radiation louvers 21 having a length shorter than that of the function enhancing louvers 15*c*, 15*h* and the heat transfer preventing louver 15*e*.

In this ninth embodiment, heat from the second heat-exchanger tubes 13 is transferred to the flat connection part 15*j* without being greatly hindered by the auxiliary heat radiation louvers 21, and accordingly, the heat is efficiently radiated from the plurality of auxiliary heat radiation louvers 21.

Furthermore, in this ninth embodiment, since the heat radiation parts are the auxiliary heat radiation louvers 21 having a length which is shorter than that of the function enhancing louvers 15*c*, 15*h* and the heat transfer preventing louver 15*e*, the function of heat radiation is enhanced without hindering the heat transfer through the flat connection part 15*j*, and thermal interference between the first heat-exchanger tubes 11 and the second heat-exchanger tubes 13 can be suppressed or at least minimized.

Figure 13:
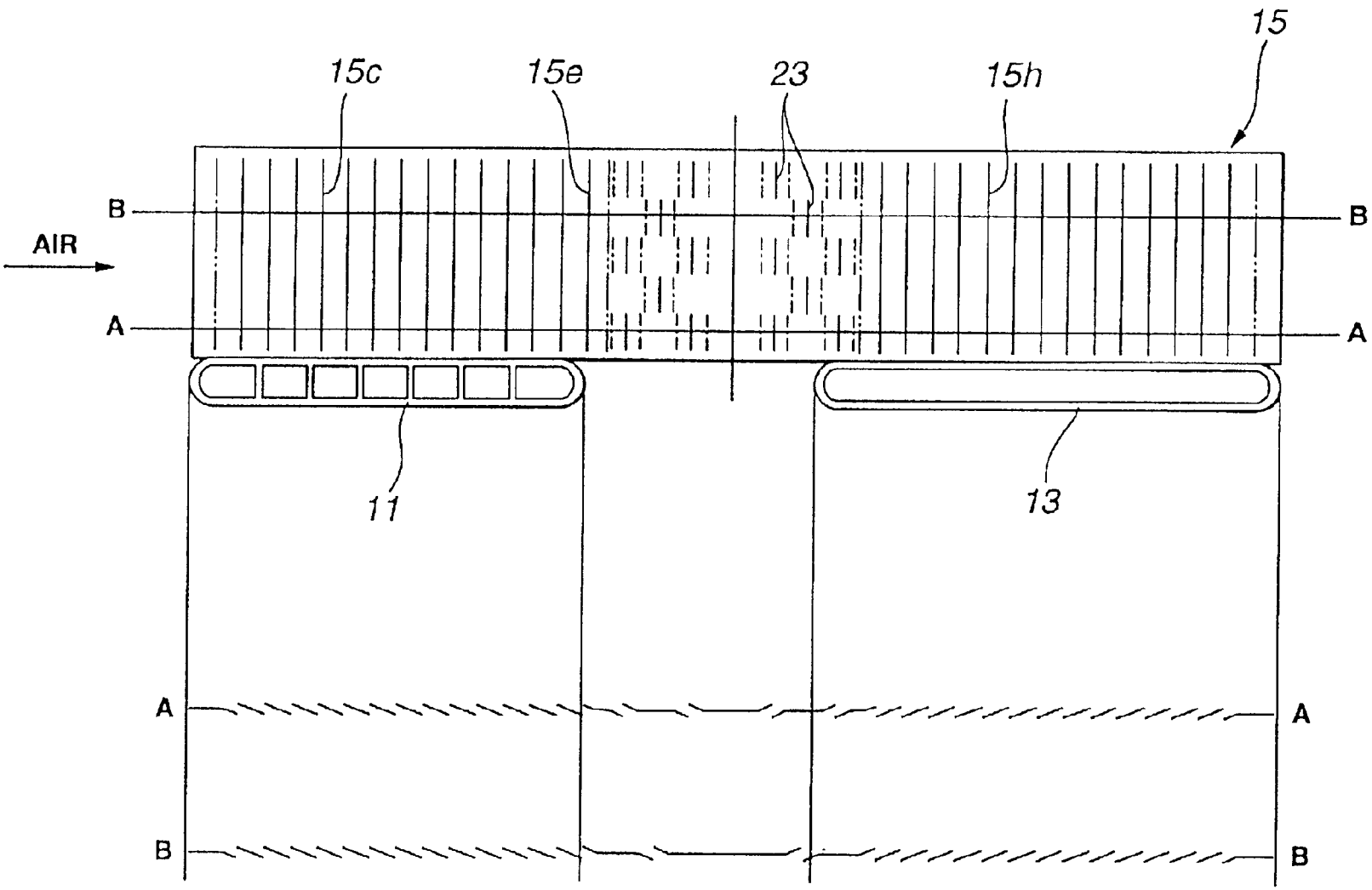
FIG. 13 is a view similar to FIG. 2, but showing a tenth embodiment of the present invention.

Referring to FIG. 13, there is shown a tenth embodiment of the present invention. In this embodiment, a plurality of auxiliary heat radiation louvers 23 constituting a heat radiation part are arranged at certain intervals in a direction perpendicular to the air flow direction.

In this tenth embodiment, since the auxiliary heat radiation louvers 23 are arranged at certain intervals in a direction perpendicular to the air flow direction, the function of heat radiation can be enhanced.

Figure 14:
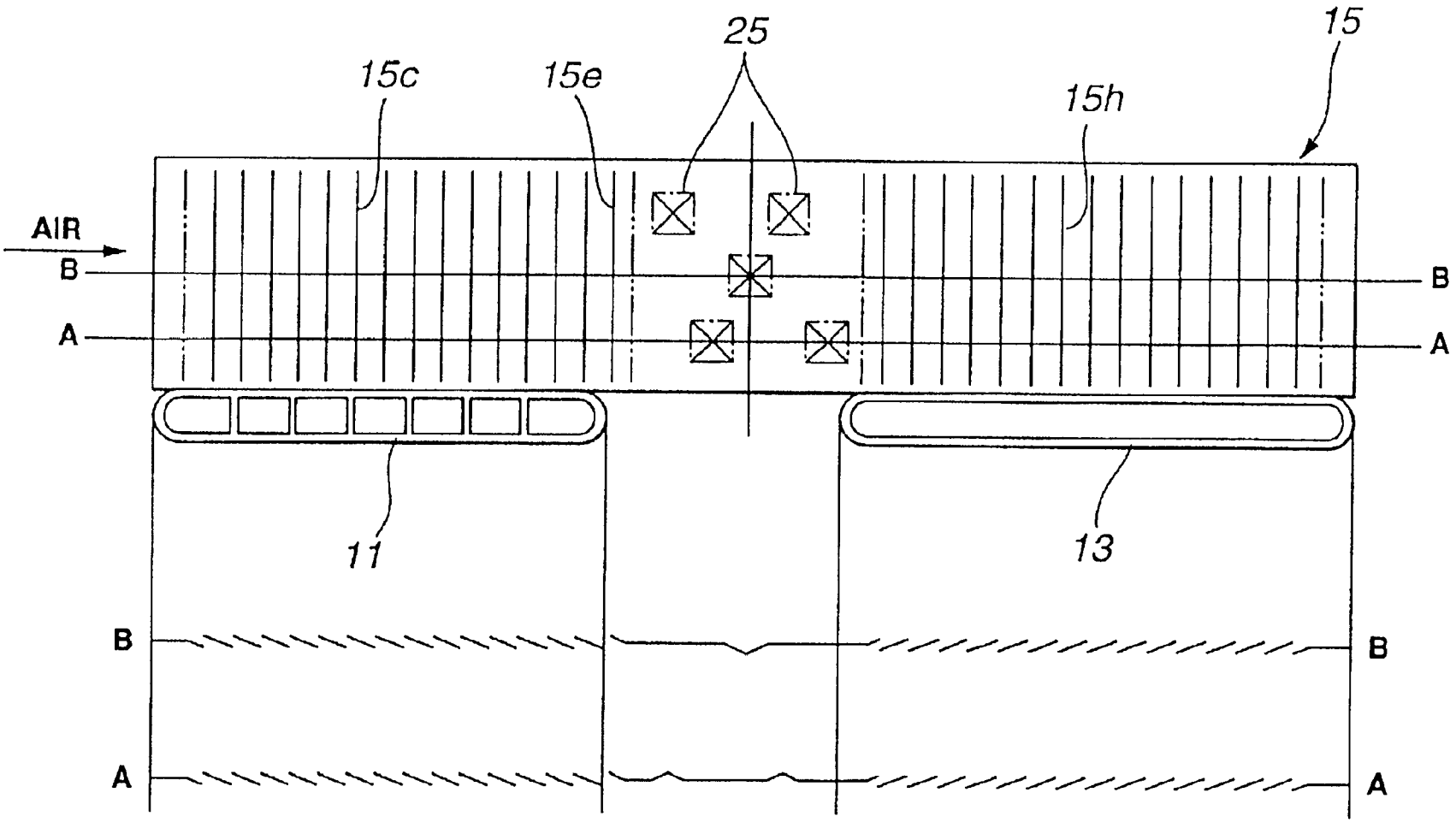
FIG. 14 is a view similar to FIG. 2, but showing an eleventh embodiment of the present invention.

Referring to FIG. 14, there is shown an eleventh embodiment of the present invention. In this embodiment, the heat radiation part has projections 25 formed in the flat connection part 15*j*. The projections 25 are formed in a pyramid shape.

In this eleventh embodiment, since the heat radiation part is composed of the projections 25 integrally incorporated with the flat connection part 15*j*, the function of heat radiation can be enhanced without hindering heat radiation through the flat connection part 15*j*.

It is to be noted that the shape of each of the projections 25 may be formed in a conical shape or a trigonal pyramid.

Figure 15:
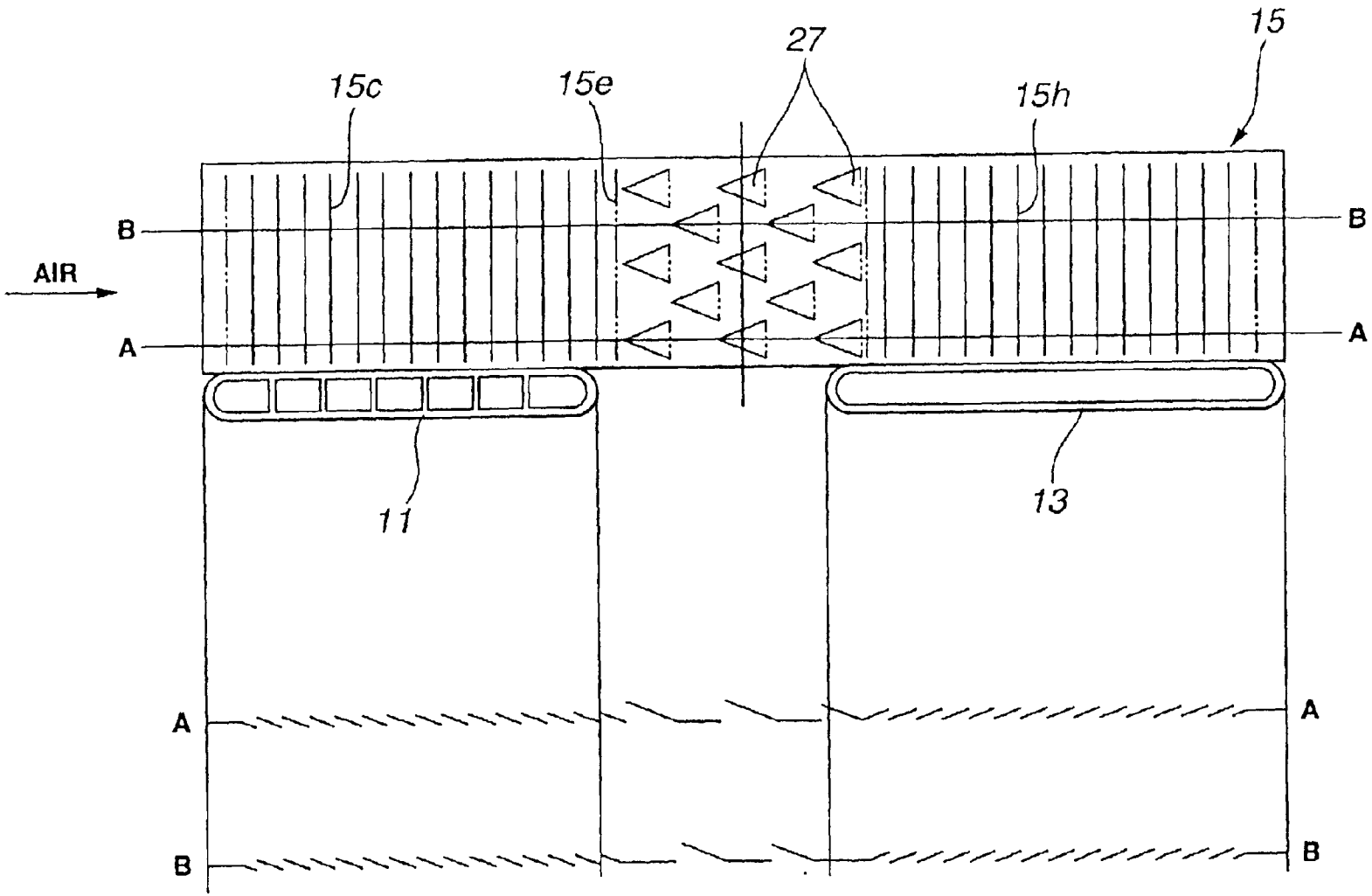
FIG. 15 is a view similar to FIG. 2, but showing a twelfth embodiment of the present invention.

Referring to FIG. 15, there is shown a twelfth embodiment of the present invention. In this embodiment, the heat radiation part has raised parts 27 formed by cutting and raising the flat connection part 15*j*. These raised parts 27 are formed in a triangular shape.

In this embodiment, since the heat radiation part is composed of the raised parts 27 formed by cutting and raising the flat connection part 15*j*, the function of heat radiation can be enhanced without greatly hindering heat transfer through the flat connection part 15*j*.

Each of the raised parts 27 may be formed in a rectangular shaped or the like.

Figure 16:
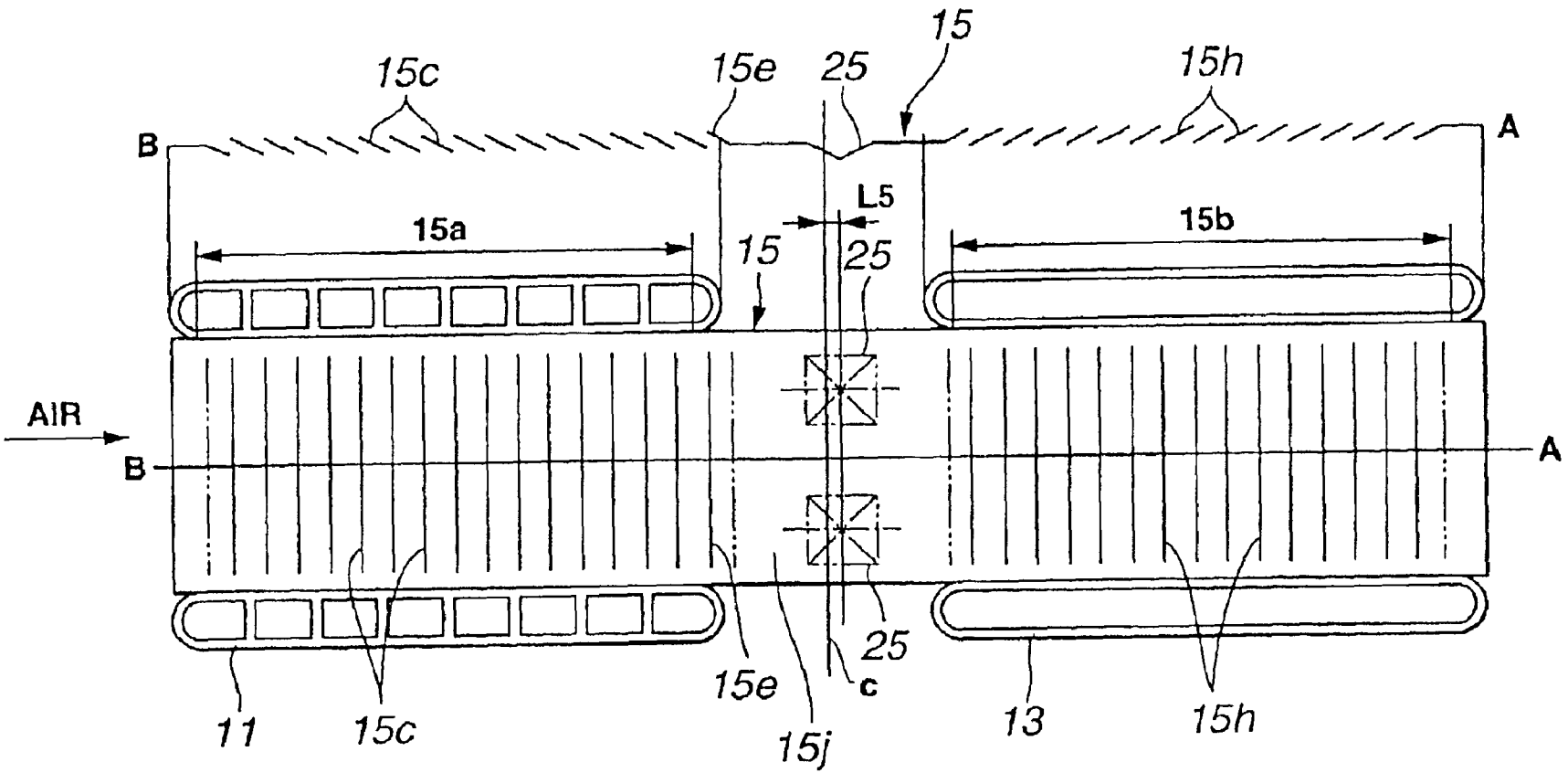
FIG. 16 is a view similar to FIG. 2, but showing a thirteenth embodiment of the present invention.

Referring to FIG. 16, there is shown a thirteenth embodiment of the present invention. In this embodiment, the length of the first joint zone 15*a* is equal to that of the second joint zone 15*b*. Furthermore, in this thirteenth embodiment, the number of the function enhancing louvers 15*c* on the first joint zone 15*a* and the heat transfer preventing louver 15*e* is 15 in total, and the number of the function enhancing louvers 15*h* on the second joint zone 15*b* is 14 in total. That is, in a zone that extends from the center line C toward a front end of the first joint zone 15*a*, there are provided fifteen louvers, while in a zone that extends from the center line C toward a rear end of the second joint zone 15*b*, there are provided 14 louvers. Furthermore, all louvers 15*c*, 15*h* and 15*e* are arranged at a constant pitch. On the flat connection part 15*j*, there are formed two pyramid-shaped projections 25. As shown, the projections 25 are located closer to the second joint zone 15*b* by a distance L5 from the center line C.

In this thirteenth embodiment, since the heat radiation projections 25 are located closer to the second joint zone 15*b* which has less louvers than the first joint zone 15*a*, undesired deformation of the corrugated fin 15, which tends to appear during processing thereof, can be suppressed or at least minimized. Laid-Open Japanese Patent Application 2000-220983 describes the deformation of a fin which occurs during the processing.

Figure 17:
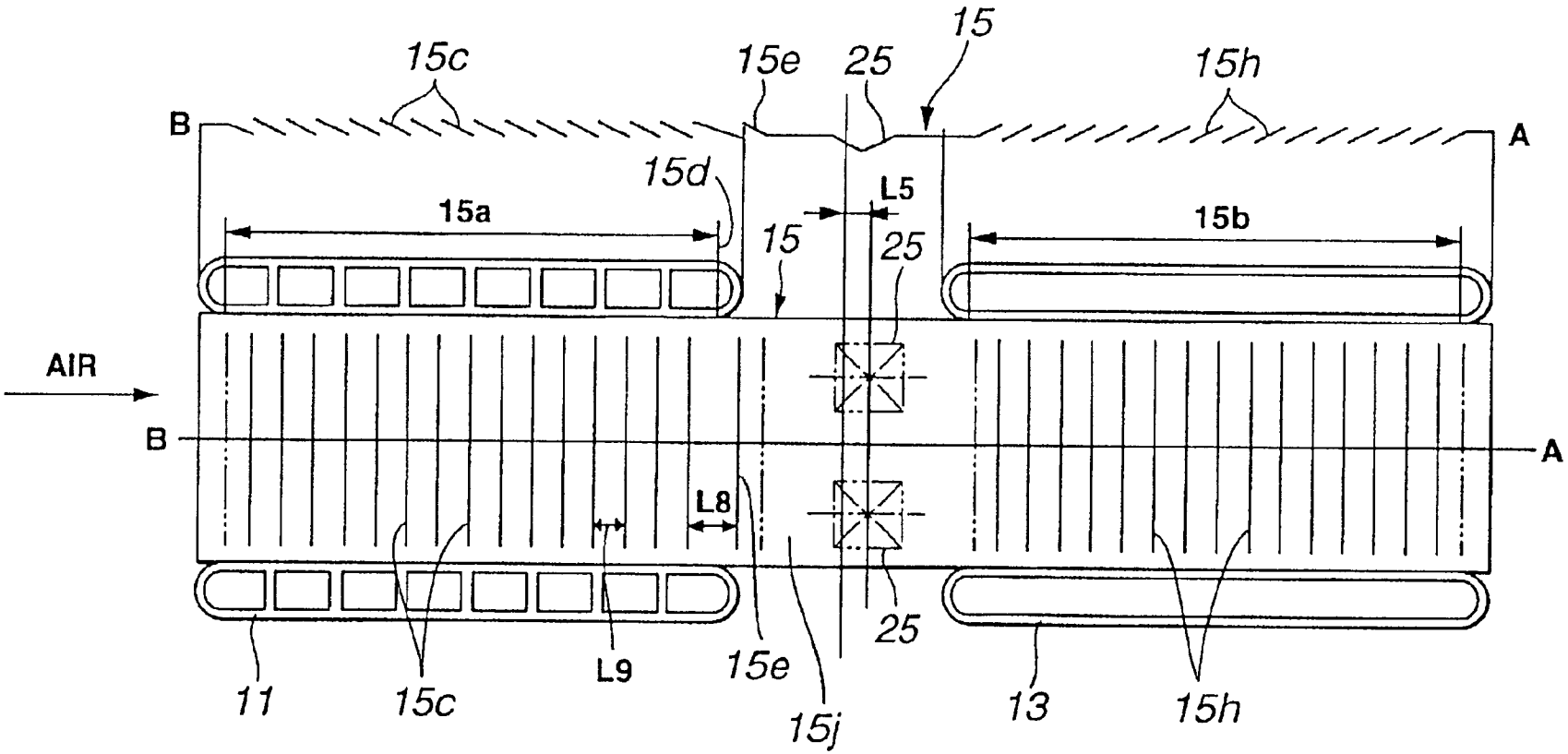
FIG. 17 is a view similar to FIG. 2, but showing a fourteenth embodiment of the present invention.
Figure 18:
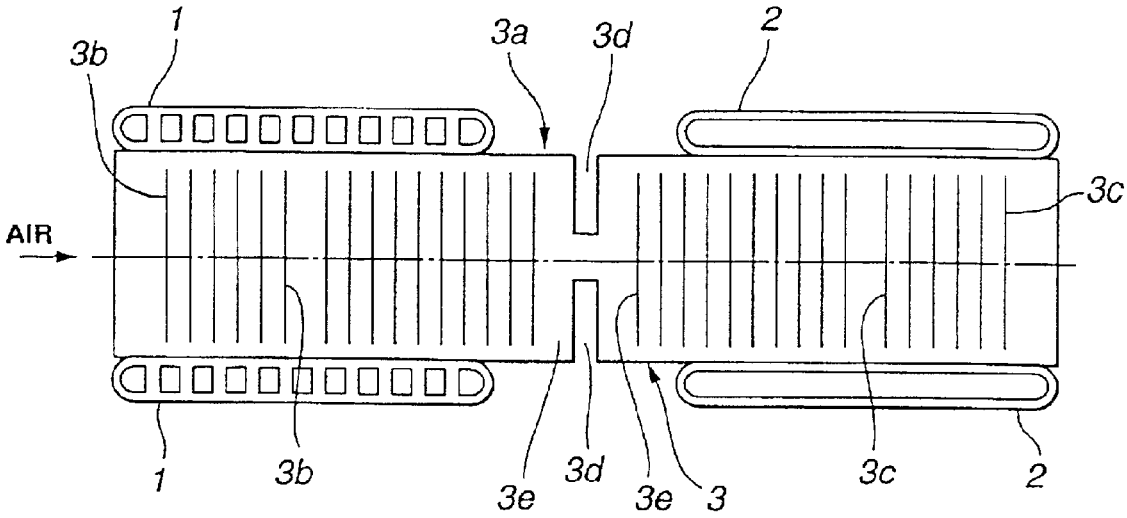
FIG.18 (PRIOR ART)
FIG. 18 is a view similar to FIG. 2, but showing a first known core structure of an integral heat-exchanger.
Figure 19:
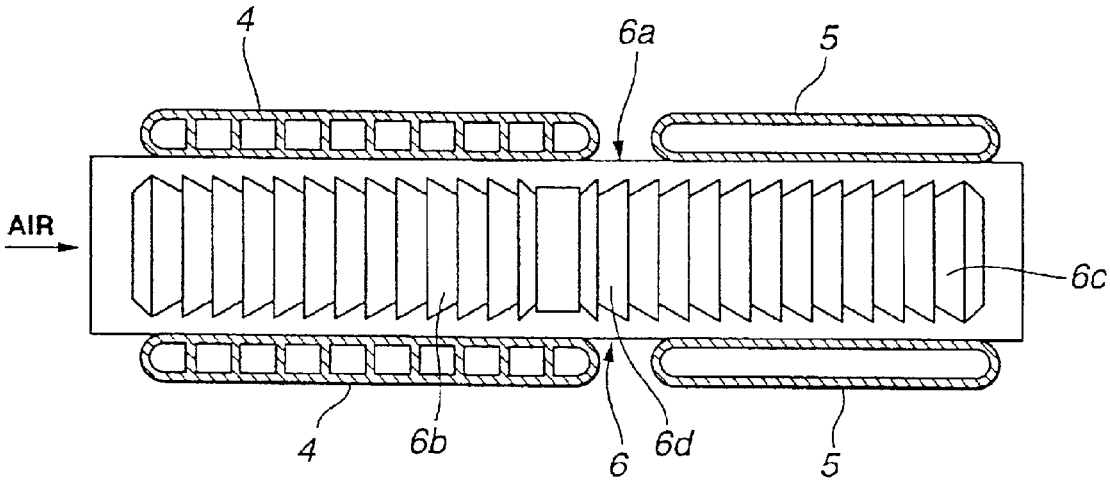
FIG.19 (PRIOR ART)
FIG. 19 is a view similar to FIG. 2, but showing a second known core structure of an integral heat-exchanger.

Referring to FIG. 17, there is shown a fourteenth embodiment of the present invention. In this embodiment, the distance L8 between the heat transfer preventing louver 15*e* and its closest function enhancing louver 15*c* of the first joint zone 15*a* is greater than the distance L9 between the two adjacent function enhancing louvers 15*c*.

Due to this arrangement, the heat transfer preventing louver 15*e* can be assuredly located inside of the inner end 15*d* of the first joint zone 15*a*. That is, during processing of the corrugated fin 15, it tends to occur that the heat transfer preventing louver 15*e* is produced at a position away from a desired position, or during assembling process, it tends to occur that the heat transfer preventing louver 15*e* is positioned away from a desired position with respect to the first and second heat-exchanger tubes 11 and 13. However, in this fourteenth embodiment, since, as is described hereinabove, the distance L8 between the heat transfer preventing louver 15*e* and its closest function enhancing louver 15*c* of the first joint zone 15*a* is greater than the distance L9 between the two adjacent function enhancing louvers 15*c*, the heat transfer preventing louver 15*e* can be assuredly located inside of the inner end 15*d* of the first joint zone 15*a*.

Although the invention has been described above with reference to the embodiments of the invention, the invention is not limited to such embodiments as described above. Various modifications and variations of such embodiments may be carried out by those skilled in the art, in light of the above descriptions.

What is claimed is:

1. A core structure of an integral heat-exchanger, comprising:

at least two first heat exchanger tubes which extend in parallel with each other;

at least two second heat exchanger tubes which extend in parallel with each other, wherein the two second heat exchanger tubes are juxtaposed with the first heat exchanger tubes; and a corrugated fin including a corrugated first part interposed between said first heat exchanger tubes, a corrugated second part interposed between said second heat exchanger tubes, and a flat connection part arranged between the corrugated first and second parts, wherein said corrugated first part of the fin is formed with a plurality of first louvers each extending substantially between the two first heat exchanger tubes, wherein said corrugated second part of the fin is formed with a plurality of second louvers each extending substantially between the two second heat exchanger tubes, wherein an innermost one of said second louvers is positioned away from an innermost end of said corrugated second part of the fin by a given length, wherein said flat connection part is formed with a third louver positioned closer to an innermost one of said first louvers than to the innermost one of said second louvers, wherein said third louver is constructed to obstruct a heat transfer in the fin, and wherein said third louver is positioned substantially across the width of said flat connection part.

2. A core structure as claimed in claim 1, wherein said first louvers and second louvers are constructed to improve a heat radiation of the fin, and wherein each of said first, second, and third louvers extends in a direction perpendicular to the direction in which air flows.

3. A core structure as claimed in claim 1, wherein said second heat exchanger tubes are located behind said first heat exchanger tubes with respect to a direction in which air flows.

4. A core structure as claimed 3, wherein said first heat exchanger tubes and said corrugated first part of the fin are adapted to act at a lower temperature, and wherein said second heat exchanger tubes and said corrugated second part of the fin are adapted to act at a higher temperature.

5. A core structure as claimed in claim 4, said first heat exchanger tubes are arranged to have a refrigerant of an automotive air conditioner flow therethrough, and wherein said second heat exchanger tubes are arranged to have an engine cooling water flow therethrough.

6. A core structure of an integral heat-exchanger, comprising:

at least two first heat exchanger tubes which extend in parallel with each other;

at least two second heat exchanger tubes which extend in parallel with each other, wherein the two second heat exchanger tubes are juxtaposed with the first heat exchanger tubes; and a corrugated fin including a corrugated first part interposed between said first heat exchanger tubes, a corrugated second part interposed between said second heat exchanger tubes, and a flat connection part arranged between the corrugated first and second parts, wherein said corrugated first part of the fin is formed with a plurality of first louvers each extending substantially between the two first heat exchanger tubes, wherein said corrugated second part of the fin is formed with a plurality of second louvers each extending substantially between the two second heat exchanger tubes, wherein an innermost one of said second louvers is positioned away from an innermost end of said corrugated second part of the fin by a given length, wherein said flat connection part is formed with a third louver in the vicinity of an innermost one of said first louvers, wherein said third louver is constructed to obstruct a heat transfer in the fin, wherein said third louver is positioned substantially across the width of the flat connection part, wherein the distance between said third louver and the innermost end of said corrugated second part of the fin is less that 12 mm, and wherein said given length is greater than a pitch at which said second louvers are arranged.

7. A core structure of an integral heat-exchanger, comprising:

at least two first heat exchanger tubes which extend in parallel with each other;

at least two second heat exchanger tubes which extend in parallel with each other, wherein the two second heat exchanger tubes are juxtaposed with the first heat exchanger tubes; and a corrugated fin including a corrugated first part interposed between said first heat exchanger tubes, a corrugated second part interposed between said second heat exchanger tubes, and a flat connection part arranged between the corrugated first and second parts, wherein said corrugated first part of the fin is formed with a plurality of first louvers each extending substantially between the two first heat exchanger tubes, wherein said corrugated second part of the fin is formed with a plurality of second louvers each extending substantially between the two second heat exchanger tubes, wherein an innermost one of said second louvers is positioned away from an innermost end of said corrugated second part of the fin by a given length, wherein said flat connection part is formed with a third louver in the vicinity of an innermost one of said first louvers, wherein said third louver is constructed to obstruct a heat transfer in the fin, wherein said third louver is positioned substantially across the width of the flat connection part, and wherein the length between said third louver and said innermost one of said second louvers is substantially equal to the length of said flat connection part of said fin.

8. A core structure as claimed in 7, wherein a front cluster including said first louvers and said third louver and a rear cluster including said second louvers are arranged symmetrically with respect to said flat connection part of said fin.

9. A core structure as claimed in claim 8, wherein a center line of said corrugated fin is located in a center portion of said flat connection part.

10. A core structure of an integral heat-exchanger, comprising:

at least two first heat exchanger tubes which extend in parallel with each other;

at least two second heat exchanger tubes which extend in parallel with each other, wherein the two second heat exchanger tubes are juxtaposed with the first heat exchanger tubes; and a corrugated fin including a corrugated first part interposed between said first heat exchanger tubes, a corrugated second part interposed between said second heat exchanger tubes, and a flat connection part arranged between the corrugated first and second parts, wherein said corrugated first part of the fin is formed with a plurality of first louvers each extending substantially between the two first heat exchanger tubes, wherein said corrugated second part of the fin is formed with a plurality of second louvers each extending substantially between the two second heat exchanger tubes, wherein an innermost one of said second louvers is positioned away from an innermost end of said corrugated second part of the fin by a given length.

wherein said flat connection part is formed with a third louver in the vicinity of an innermost one of said first louvers, wherein said third louver is constructed to obstruct a heat transfer in the fin, wherein said third louver is positioned substantially across the width of said flat connection part, and wherein the width of the first heat exchanger tubes is different from that of the second heat exchanger tubes.

* * * * *